US010551864B2

(12) United States Patent
Chen et al.

(10) Patent No.: US 10,551,864 B2
(45) Date of Patent: Feb. 4, 2020

(54) BANDGAP VOLTAGE REFERENCE CIRCUIT

(71) Applicant: RichWave Technology Corp., Taipei (TW)

(72) Inventors: Che-Sheng Chen, Taipei (TW); Shun-Nan Tai, Taipei (TW)

(73) Assignee: RichWave Technology Corp., Taipei (TW)

( * ) Notice: Subject to any disclaimer, the term of this patent is extended or adjusted under 35 U.S.C. 154(b) by 0 days.

(21) Appl. No.: 16/170,060

(22) Filed: Oct. 25, 2018

(65) Prior Publication Data

US 2020/0012308 A1 Jan. 9, 2020

(30) Foreign Application Priority Data

Jul. 5, 2018 (TW) ..... 107123382

(51) Int. Cl.
*G05F 3/02* (2006.01)
*G05F 3/30* (2006.01)
*G05F 1/563* (2006.01)

(52) U.S. Cl.
CPC ..... *G05F 3/30* (2013.01); *G05F 1/563* (2013.01)

(58) Field of Classification Search
CPC ..... G05F 3/245; G05F 3/247; G05F 3/262; G05F 3/265; G05F 3/267; G05F 3/30; G05F 1/563
See application file for complete search history.

(56) References Cited

U.S. PATENT DOCUMENTS 8,040,123 B2 * 10/2011 Yanagawa ..... G05F 3/30 323/313
2011/0037451 A1 * 2/2011 Shiina ..... G05F 3/30 323/313

* cited by examiner

*Primary Examiner* — Long Nguyen
(74) *Attorney, Agent, or Firm* — JCIPRNET

(57) ABSTRACT

A bandgap voltage reference circuit configured to generate a bandgap reference voltage is provided. The bandgap voltage reference circuit includes a bandgap current generating circuit, a differential pair circuit and a flipped voltage follower. The bandgap current generating circuit converts the bandgap reference voltage into a bandgap current and generates a first voltage and a second voltage according to the bandgap current. The differential pair circuit is coupled to the bandgap current generating circuit to receive the first voltage and the second voltage and configured to reduce a voltage difference between the first voltage and the second voltage and generate a third voltage. The flipped voltage follower is coupled to the differential pair circuit to receive the third voltage and generates the bandgap reference voltage accordingly.

19 Claims, 7 Drawing Sheets

BANDGAP VOLTAGE REFERENCE CIRCUIT

CROSS-REFERENCE TO RELATED APPLICATION

This application claims the priority benefit of Taiwan application serial no. 107123382, filed on Jul. 5, 2018. The entirety of the above-mentioned patent application is hereby incorporated by reference herein and made a part of this specification.

TECHNICAL FIELD

The invention relates to a voltage generating circuit, and particularly relates to a bandgap voltage reference circuit.

BACKGROUND

Digital-to-analog converters (DACs), analog-to-digital converters (ADCs), or low-dropout regulators (LDOs) generally require at least one stable reference voltage. The reference voltage needs to be steadily regenerated every time when the power turns on, and such reference voltage needs to be kept away from process, temperature or electrical variations, etc.

A bandgap voltage reference circuit may be used to provide such a reference voltage. Therefore, bandgap voltage reference circuits play an important role in many very large scale integrated (VLSI) circuit systems, and determine the overall stability and precision of the systems. A common bandgap voltage reference circuit usually adopts a two-stage amplifying circuit framework and is used with a Miller capacitor for frequency compensation. However, the speed for starting such bandgap voltage reference circuit is usually slower. Besides, the driving ability of the common bandgap voltage reference circuit is also insufficient, which limits its application as the bandgap voltage reference circuit. Therefore, how to increase the starting speed and facilitate the driving ability of the bandgap voltage reference circuit is an issue for the artisans of the field to work on.

SUMMARY

Accordingly, one or some exemplary embodiments of the invention provide a bandgap voltage reference circuit for generating a bandgap reference voltage. A bandgap voltage reference circuit according to an embodiment includes a bandgap current generating circuit, a differential pair circuit, and a flipped voltage follower. The bandgap current generating circuit converts the bandgap reference voltage into a bandgap current and generates a first voltage and a second voltage according to the bandgap current. The differential pair circuit is coupled to the bandgap current generating circuit to receive the first voltage and the second voltage and configured to reduce a voltage difference between the first voltage and the second voltage and generate a third voltage. The flipped voltage follower is coupled to the differential pair circuit to receive the third voltage and generates the bandgap reference voltage accordingly.

In order to make the aforementioned and other features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION

Figure 1:
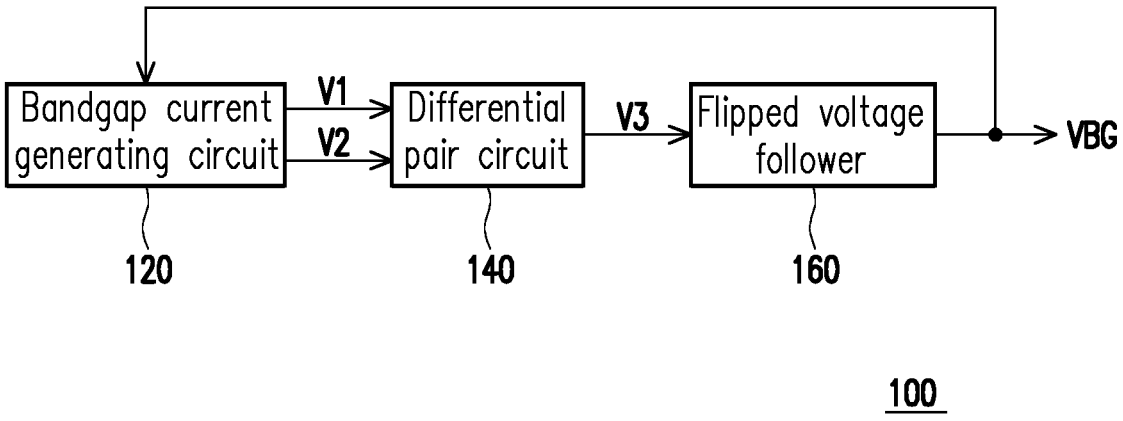
FIG. 1 is a schematic block diagram illustrating a bandgap voltage reference circuit according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Referring to FIG. 1, FIG. 1 is a schematic block diagram illustrating a bandgap voltage reference circuit according to an embodiment of the invention. The bandgap voltage reference circuit 100 serves to generate a bandgap reference voltage VBG. The bandgap voltage reference circuit 100 includes a bandgap current generating circuit 120, a differential pair circuit 140, and a flipped voltage follower (FVF) 160. However, the invention is not limited thereto. The bandgap current generating circuit 120 serves to convert the bandgap reference voltage VBG into a bandgap current and generates a voltage V1 and a voltage V2 according to the bandgap current. The differential pair circuit 140 is coupled to the bandgap current generating circuit 120 to receive the voltage V1 and the voltage V2, and serves to reduce a voltage difference between the voltage V1 and the voltage V2 and generate a voltage V3. The flipped voltage follower 160 is coupled to the differential pair circuit 140 to receive the voltage V3 and generates the bandgap reference voltage VBG accordingly. In particular, since an equivalent capacitance at an input end of the flipped voltage follower 160 is small, the frequency of an equivalent pole of an output end of the differential pair circuit 140 leans toward a high frequency, so the starting speed or responding speed of the bandgap voltage reference circuit 100 can be increased. In addition, when serving as an output stage of the bandgap voltage reference circuit 100, the flipped voltage follower 160 is able to effectively facilitate the driving ability of the bandgap reference voltage VBG.

Figure 2:
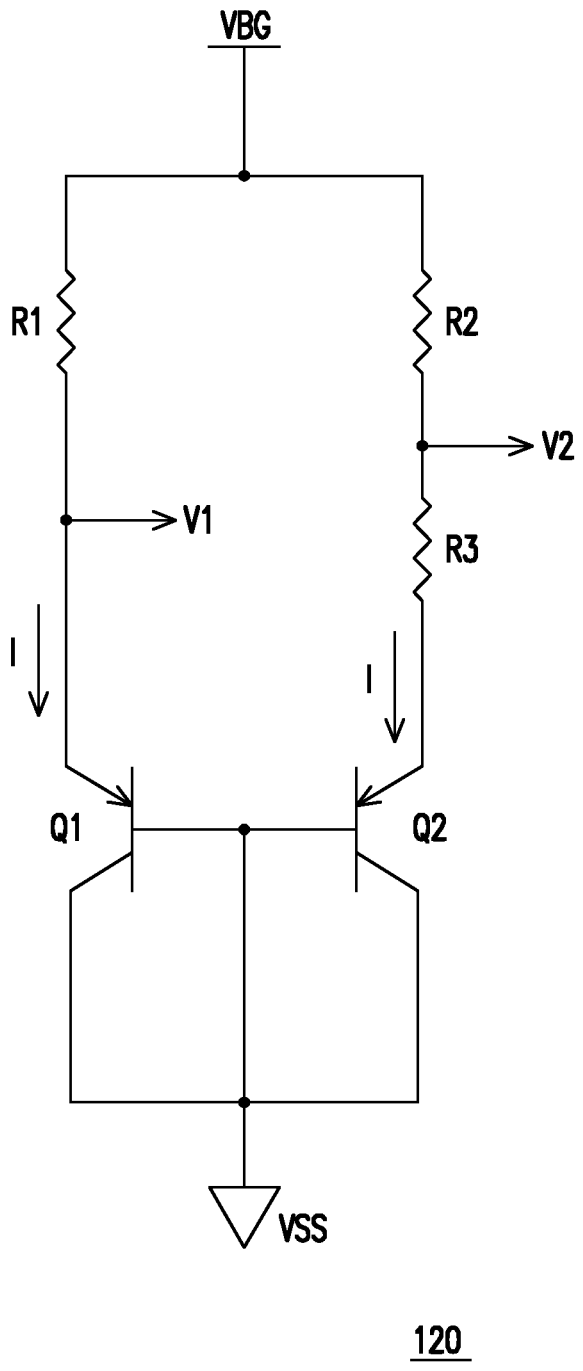
FIG. 2 is a schematic diagram illustrating a circuit framework of a bandgap current generating circuit according to an embodiment of the invention.

Referring to FIG. 2, FIG. 2 is a schematic diagram illustrating a circuit framework of a bandgap current generating circuit according to an embodiment of the invention. The bandgap current generating circuit 120 includes a transistor Q1, a transistor Q2, a resistor R1, a resistor R2, and a resistor R3. However, the invention is not limited thereto. A first end and a control end of the transistor Q1 are coupled to a reference voltage end VSS. A first end of the resistor R1 receives the bandgap reference voltage VBG, and a second end of the resistor R1 is coupled to a second end of the transistor Q1 to output the voltage V1. A first end and a control end of the transistor Q2 are coupled to the reference voltage end VSS. A first end of the resistor R2 receives the bandgap reference voltage VBG. A first end of the resistor R3 is coupled to a second end of the resistor R2 to output the voltage V2, and a second end of the resistor R3 is coupled to a second end of the transistor Q2. In an embodiment of the invention, the transistor Q2 is actually formed by N transistors Q1 connected in parallel, wherein N is, for example, a positive integer such as 8 or 25.

In an embodiment of the invention, each of the transistor Q1 and the transistor Q2 may be a bipolar junction transistor (BJT), wherein the first end of each of the transistor Q1 and the transistor Q2 is a collector end of the bipolar junction transistor, the control end of each of the transistor Q1 and the transistor Q2 is the base end of the bipolar junction transistor, and the second end of each of the transistor Q1 and the transistor Q2 is an emitter end of the bipolar junction transistor. However, the invention is not limited thereto. In an embodiment of the invention, the reference voltage end VSS may be, for example, a ground voltage end or a common voltage end. However, the invention is not limited thereto. For the ease of description, the operation of the bandgap current generating circuit 120 is described with an example where the transistor Q1 and the transistor Q2 are bipolar junction transistors and the reference voltage end VSS is a ground voltage end.

Referring to FIGS. 1 and 2, if currents flowing through the transistor Q1 and the transistor Q2 are both I, the voltage V1 may be set to be close to the voltage V2 based on a gain of the differential pair circuit 140. In this way, the current I may be derived as indicated by Formula (1), and the bandgap reference voltage VBG may be derived as indicated in Formula (2), wherein VEB1 represents an emitter-base voltage of the transistor Q1 and VEB2 represents an emitter-base voltage of the transistor Q2.

$$I = \frac{VEB1 - VEB2}{R3} \quad \text{Formula (1)}$$

$$VBG = VEB1 + I \times R1 = VEB1 + \frac{R1}{R3}(VEB1 - VEB2) = VEB1 + \frac{R1}{R3}(\Delta VEB) \quad \text{Formula (2)}$$

Since the emitter-base voltage VEB1 is a negative temperature coefficient, and ΔVEB is a positive temperature coefficient, the bandgap reference voltage VBG may be kept from the influence of temperature and set as a smaller or a zero temperature coefficient by suitably adjusting the resistance values of the resistor R1 and the resistor R3.

Figure 3:
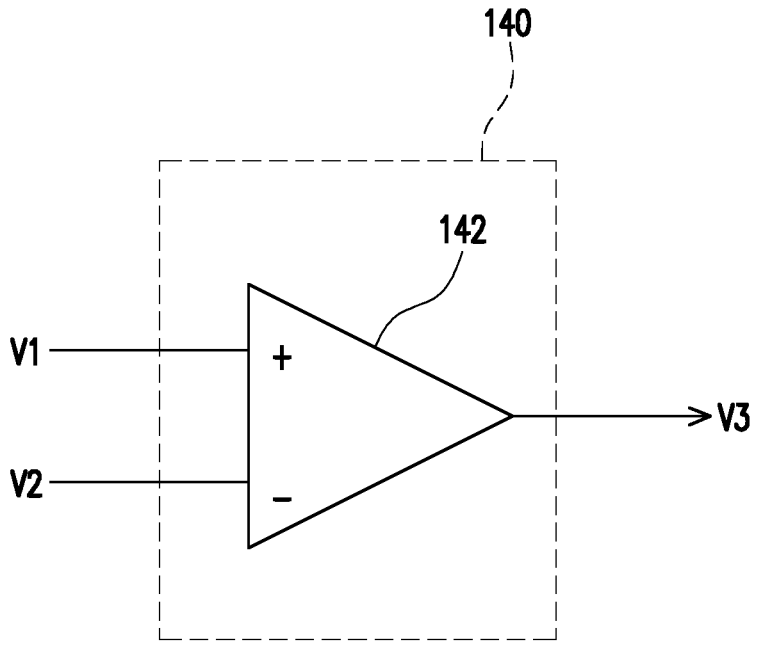
FIG. 3 is a schematic diagram illustrating a differential pair circuit according to an embodiment of the invention.

Referring to FIG. 3, FIG. 3 is a schematic diagram illustrating a differential pair circuit according to an embodiment of the invention. The differential pair circuit 140 may include an operational amplifier 142. A non-inverting input end of the operational amplifier 142 receives the voltage V1, and an inverting input end of the operational amplifier 142 receives the voltage V2. In addition, an output end of the operational amplifier 142 outputs the voltage V3. The operational amplifier 142 may amplify a voltage difference between the voltage V1 and the voltage V2 to generate the voltage V3.

Figure 4:
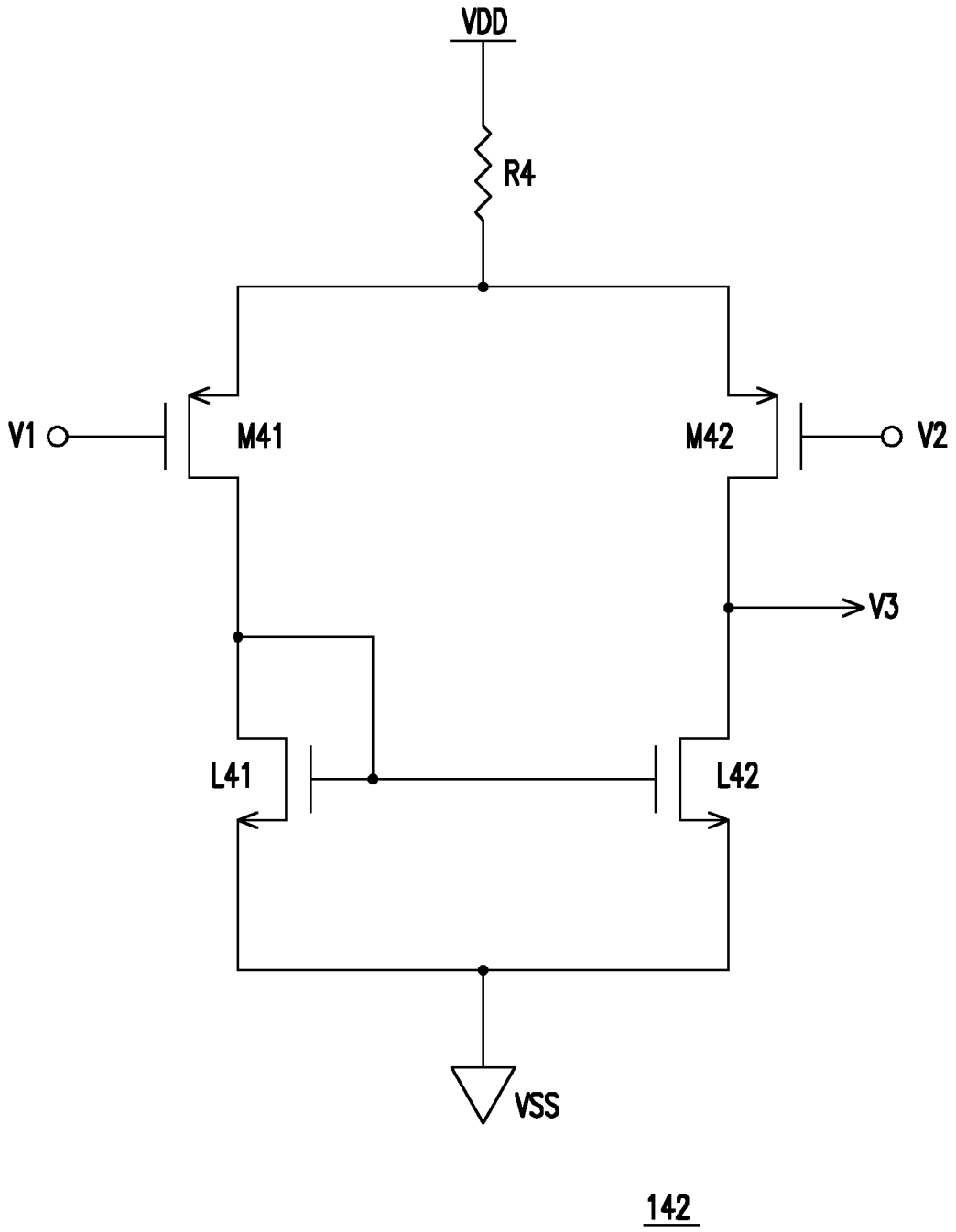
FIG. 4 is a schematic diagram illustrating a circuit framework of an operational amplifier according to an embodiment of the invention.

In an embodiment of the invention, as shown in FIG. 4, the operational amplifier 142 may include a bias resistor R4, an input transistor M41, an input transistor M42, a load transistor L41, and a load transistor L42. A first end of the bias resistor R4 is coupled to an operational voltage end VDD. A first end of the input transistor M41 is coupled to a second end of the bias resistor R4. A control end of the input transistor M41 receives the voltage V1. A first end of the input transistor M42 is coupled to the second end of the bias resistor R4. A control end of the input transistor M42 receives the voltage V2. A first end of the load transistor L41 is coupled to the reference voltage end VSS. A control end of the load transistor L41 is coupled to its second end and is coupled to a second end of the input transistor M41. A first end of the load transistor L42 is coupled to the reference voltage end VSS. A control end of the load transistor L42 is coupled to the control end of the load transistor L41. A second end of the load transistor L42 is coupled to a second end of the input transistor M42 to output the voltage V3. In one embodiment, a voltage of the operational voltage end VDD is higher than a voltage of the reference voltage end VSS.

In an embodiment of the invention, each of the input transistor M41 and the input transistor M42 may be a P-type metal-oxide-semiconductor field-effect transistor (MOSFET), wherein the first end of each of the input transistor M41 and the input transistor M42 is the source end of the P-type MOSFET, the control end of each of the input transistor M41 and the input transistor M42 is the gate end of the P-type MOSFET, and the second end of each of the input transistor M41 and the input transistor M42 is the drain end of the P-type MOSFET. In addition, each of the load transistor L41 and the load transistor L42 may be an N-type MOSFET, wherein the first end of each of the load transistor L41 and the load transistor L42 is the source end of the N-type MOSFET, the control end of each of the load transistor L41 and the load transistor L42 is the gate end of the N-type MOSFET, and the second end of each of the load transistor L41 and the load transistor L42 is the drain end of the N-type MOSFET.

Figure 5:
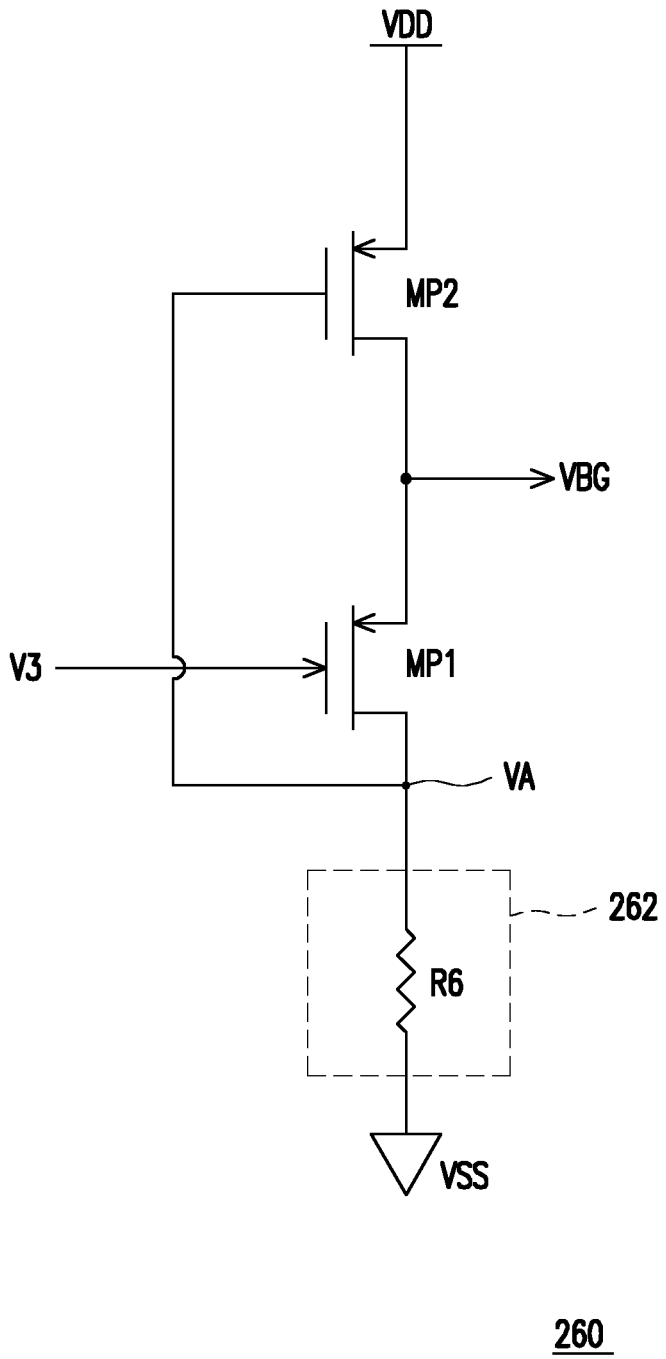
FIG. 5 is a schematic diagram illustrating a circuit framework of a flipped voltage follower according to an embodiment of the invention.

Referring to FIG. 5, FIG. 5 is a schematic diagram illustrating a circuit framework of a flipped voltage follower according to an embodiment of the invention. A flipped voltage follower 260 may include a current source circuit 262, a transistor MP1 and a transistor MP2. However, the invention is not limited thereto. A first end of the current source circuit 262 is coupled to the reference voltage end VSS. A first end of the transistor MP1 is coupled to a second end of the current source circuit 262 to provide a voltage VA. A control end of the transistor MP1 is coupled to the differential pair circuit 140 of FIG. 1 to receive the voltage V3. A second end of the transistor MP2 is coupled to the operational voltage end VDD. A control end of the transistor MP2 is coupled to the second end of the current source circuit 262 to receive the voltage VA. A first end of the transistor MP2 is coupled to a second end of the transistor MP1 to output the bandgap reference voltage VBG.

In an embodiment of the invention, the current source circuit 262 may include a resistor R6. The resistor R6 is coupled between the first end of the transistor MP1 and the reference voltage end VSS.

In an embodiment, the transistor MP1 and the transistor MP2 may be P-type MOSFETs, wherein the first end of each of the transistor MP1 and the transistor MP2 is the drain end of the P-type MOSFET, the control end of each of the transistor MP1 and the transistor MP2 is the gate end of the P-type MOSFET, and the second end of each of the transistor MP1 and the transistor MP2 is the source end of the P-type MOSFET.

In an embodiment of the invention, the size of the transistor MP2 is larger than the size of the transistor MP1. In another embodiment of the invention, the size of the transistor MP2 is 20 times to 100 times of the size of the transistor MP1. However, the invention is not limited thereto. It shall be appreciated that, since the size of the transistor MP1 is smaller, and no Miller resistor is disposed between the input end and an output end of the flipped voltage follower 260, the equivalent capacitance at the input end of the flipped voltage follower 260 is small. In this way, the frequency of the equivalent pole of the output end of the differential pair circuit 140 of FIG. 1 is set to lean toward a high frequency, so the starting speed or responding speed of the bandgap voltage reference circuit 100 of FIG. 1 can be increased. Besides, due to the larger size, the transistor MP2 is able to provide a greater driving current. Therefore, the transistor MP2 is able to facilitate the driving ability of the bandgap reference voltage VBG. Consequently, the bandgap voltage reference circuit 100 is applicable to a circuit design with the needs of rapid power charging and discharging. In the following, the overall operation of the flipped voltage follower 260 is described.

When the bandgap reference voltage VBG is too low (e.g., a voltage difference between the bandgap reference voltage VBG and the voltage V3 is less than a threshold voltage value of the transistor MP1), the transistor MP1 is cut off, and the voltage VA is therefore lowered. Due to lowering of the voltage VA, the transistor MP2 is turned on and a current is introduced to the operational voltage end VDD, so that the bandgap reference voltage VBG can be increased to a predetermined voltage value.

Similarly, when the bandgap reference voltage VBG is too high (e.g., the voltage difference between the bandgap reference voltage VBG and the voltage V3 is greater than a threshold voltage value of the transistor MP1), the transistor MP1 is turn on, and the voltage VA is therefore increased. Due to the increase of the voltage VA, the transistor MP2 is cut off to stop introducing a current from the operational voltage end VDD. In this way, the bandgap reference voltage VBG can be lowered to the predetermined voltage value.

Figure 6:
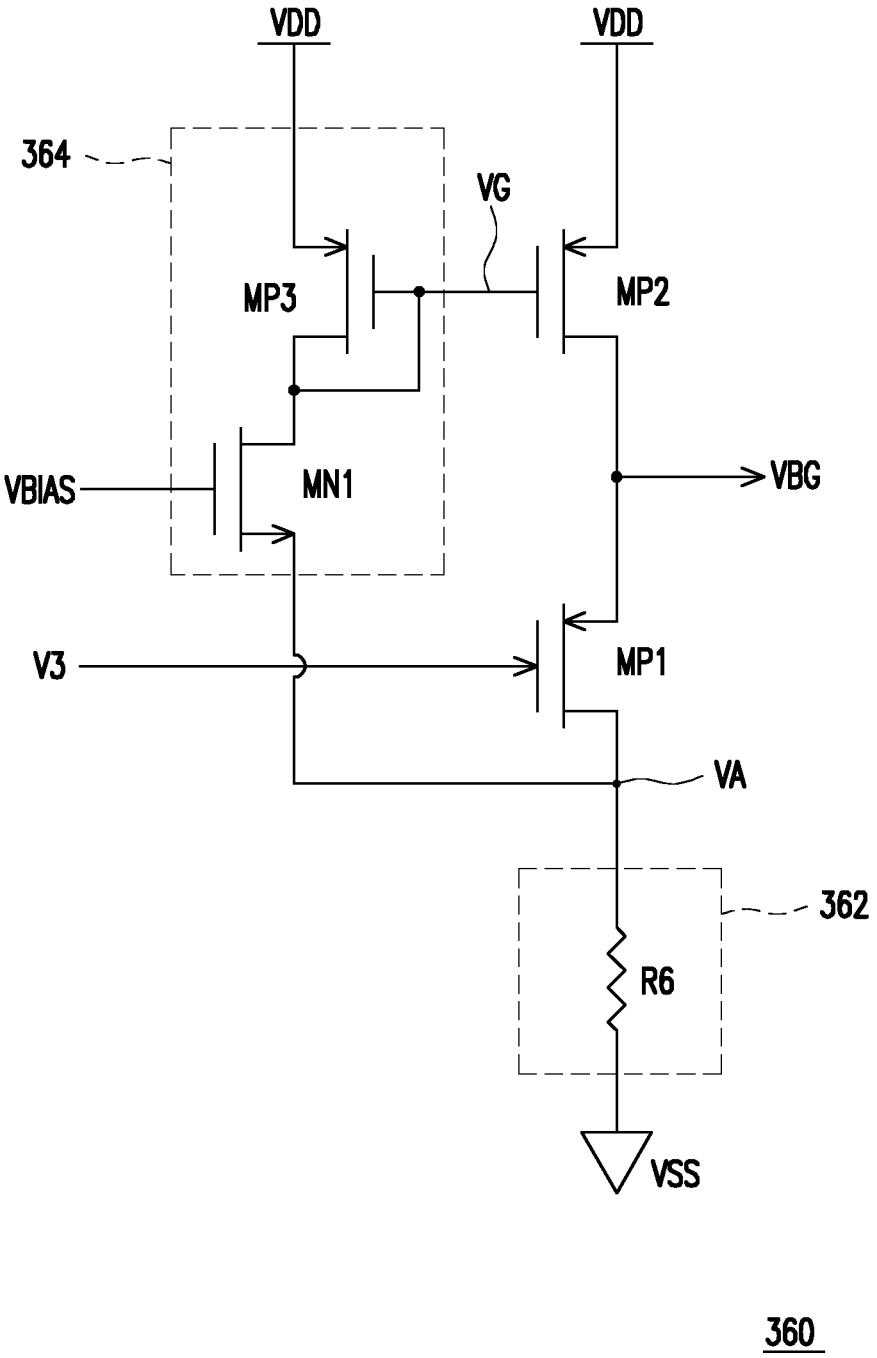
FIG. 6 is a schematic diagram illustrating a circuit framework of a flipped voltage follower according to another embodiment of the invention.

In some high-voltage applications, the voltage of the operational voltage end VDD may be a high voltage, whereas the voltage VA is a relatively low voltage. In this way, the transistor MP2 may be unable to be turned off due to an excessive voltage difference between the second end and the control end of the transistor MP2, or the transistor MP2 may even be broken down due to a high voltage difference. Accordingly, referring to FIG. 6, FIG. 6 is a schematic diagram illustrating a circuit framework of a flipped voltage follower according to another embodiment of the invention. A flipped voltage follower 360 may include a current source circuit 362, the transistor MP1, the transistor MP2, and a voltage adjusting circuit 364. However, the invention is not limited thereto. Implementations of the current source circuit 362, the transistor MP1, and the transistor MP2 shown in FIG. 6 are respectively similar to the current source circuit 262, the transistor MP1, and the transistor MP2 of FIG. 5. Therefore, details in this regard may be referred to relevant descriptions of FIG. 5 above and shall not be repeated in the following.

The voltage adjusting circuit 362 is coupled between the second end of the current source circuit 362 and the control end of the transistor MP2 to generate and output a control voltage VG to the control end of the transistor MP2 according to the voltage VA. More specifically, compared with the embodiment of FIG. 5 in which the transistor MP2 is directly controlled by the voltage VA, the transistor MP2 in FIG. 6 is controlled by the control voltage VG, and the control voltage VG is higher than the voltage VA. It shall be appreciated that, with the design of the voltage adjusting circuit 362 in FIG. 6, the transistor MP2 could be prevented from being unable to be turned off or being broken down due to an excessive voltage difference between the second end and the control end of the second transistor MP2.

In an embodiment of the invention, the voltage adjusting circuit 364 may include a transistor MN1 and a transistor MP3. A control end of the transistor MN1 is coupled to a bias voltage end VBIAS to receive a bias voltage, such as a stable or a fixed bias voltage. A second end of the transistor MN1 is coupled to the second end of the current source circuit 362 to receive the voltage VA. A second end of the transistor MP3 is coupled to the operational voltage end VDD. A control end of the transistor MP3 is coupled to its first end, and is coupled to the control end of the transistor MP2 and a first end of the transistor MN1 to output the control voltage VG.

In an embodiment, the transistor MN1 may be an N-type MOSFET, wherein the first end of the transistor MN1 is the drain end of the N-type MOSFET, the control end of the transistor MN1 is the gate end of the N-type MOSFET, and the second end of the transistor MN1 is the source end of the N-type MOSFET. Besides, the transistor MP3 may be a P-type MOSFET, wherein the first end of the transistor MP3 is the drain end of the P-type MOSFET, the control end of the transistor MP3 is the gate end of the P-type MOSFET, and the second end of the transistor MP3 is the source end of the P-type MOSFET. In the following, the overall operation of the flipped voltage follower 360 is described.

When the bandgap reference voltage VBG is too low (e.g., a voltage difference between the bandgap reference voltage VBG and the voltage V3 is less than a threshold voltage value of the transistor MP1), the transistor MP1 is cut off, and the voltage VA is therefore lowered. Due to lowering of the voltage VA, the transistor MN1 is turned on, so that the control voltage VG is lowered to turn on the transistor MP2. After the transistor MP2 is turned on, a current may be introduced from the operational voltage end VDD, so as to increase the bandgap reference voltage VBG to the predetermined voltage value.

Similarly, when the bandgap reference voltage VBG is too high (e.g., the voltage difference between the bandgap reference voltage VBG and the voltage V3 is greater than a threshold voltage value of the transistor MP1), the transistor MP1 is turn on, and the voltage VA is therefore increased. Due to the increase of the voltage VA, the transistor MN1 is cut off. Accordingly, the control voltage VG is increased and the transistor MP2 is turned off After the transistor MP2 is turned off, a current is stopped from being introduced from the operational voltage end VDD. Accordingly, the bandgap reference voltage VBG may be lowered to the predetermined voltage value.

Figure 7:
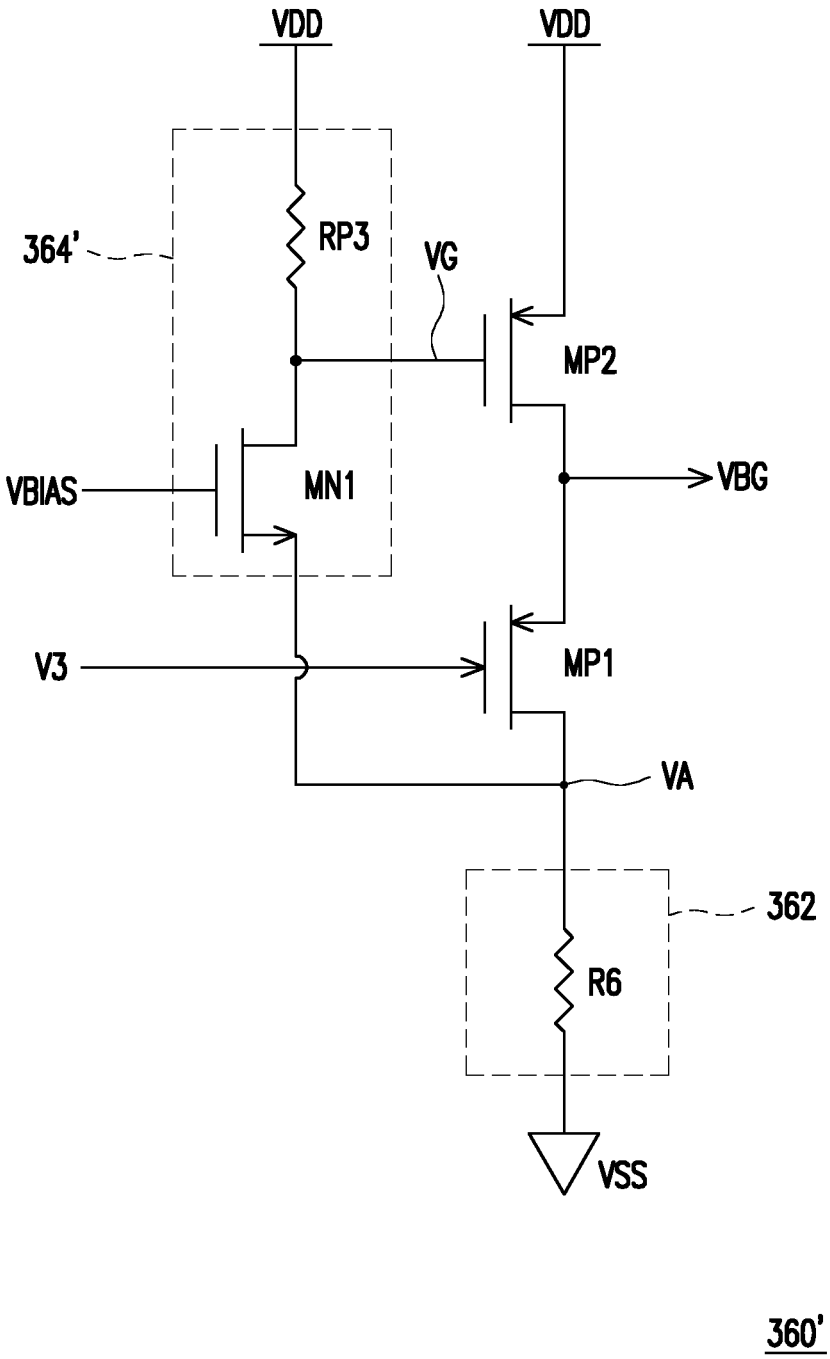
FIG. 7 is a schematic diagram illustrating a circuit framework of a flipped voltage follower according to yet another embodiment of the invention.

Referring to FIG. 7, FIG. 7 is a schematic diagram illustrating a circuit framework of a flipped voltage follower according to yet another embodiment of the invention. A flipped voltage follower 360' may include the current source circuit 362, the transistor MP1, the transistor MP2, and a voltage adjusting circuit 364'. However, the invention is not limited thereto. The current source circuit 362, the transistor MP1, the transistor MP2, and the voltage adjusting circuit 364' of FIG. 7 are respectively similar to the current source circuit 362, the transistor MP1, the transistor MP2, and the voltage adjusting circuit 364 of FIG. 6. However, a difference therebetween is that the voltage adjusting circuit 364' of FIG. 7 adopts a resistor RP3 to replace the transistor MP3 of FIG. 6.

Specifically, the voltage adjusting circuit 364' of FIG. 7 includes the transistor MP1 and the resistor RP3. The transistor MN1 of FIG. 7 is similar to the transistor MN1 of FIG. 6, a first end of the resistor RP3 is coupled to the operational voltage end VDD, a second end of the resistor RP3 is coupled to the control end of the transistor MP2 and the first end of the transistor MN1 to output the control voltage VG. Details for implementing the flipped voltage follower 360' and the operation thereof may be referred to relevant descriptions of the flipped voltage follower 360 of FIG. 6 above and will therefore not be repeated in the following.

In view of the foregoing, the embodiments of the invention provide a bandgap voltage reference circuit having a quick starting speed and a greater output driving ability. In the bandgap voltage reference circuit proposed in the embodiments of the invention, the flipped voltage follower is adopted as the output stage. Since the equivalent capacitance at the input end of the flipped voltage follower is small, the frequency of the equivalent pole of the output end of the differential pair circuit leans toward a high frequency. Therefore, the starting speed or the responding speed of the bandgap voltage reference circuit is increased. Besides, the flipped voltage follower may further effectively facilitate the driving ability of the bandgap reference voltage. Therefore, the bandgap voltage reference circuit according to the embodiments of the invention is applicable to a circuit design with the needs of rapid power charging and discharging.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A bandgap voltage reference circuit for generating a bandgap reference voltage, the bandgap voltage reference circuit comprising:

a bandgap current generating circuit configured to convert the bandgap reference voltage into a bandgap current and generate a first voltage and a second voltage according to the bandgap current;

a differential pair circuit, coupled to the bandgap current generating circuit to receive the first voltage and the second voltage, and configured to reduce a voltage difference between the first voltage and the second voltage, and generate a third voltage; and a flipped voltage follower, coupled to the differential pair circuit to receive the third voltage, configured to generate the bandgap reference voltage accordingly, and comprising:

a current source circuit, wherein a first end of the current source circuit is coupled to a reference voltage end;

a first transistor, wherein a first end of the first transistor is coupled to a second end of the current source circuit to provide a fourth voltage, and a control end of the first transistor is coupled to the differential pair circuit to receive the third voltage; and a second transistor, wherein a second end of the second transistor is coupled to an operational voltage end, a control end of the second transistor is coupled to the second end of the current source circuit to receive the fourth voltage, and a first end of the second transistor is coupled to a second end of the first transistor to output the bandgap reference voltage.

2. The bandgap voltage reference circuit as claimed in claim 1, wherein the flipped voltage follower is further configured to facilitate a driving ability of the bandgap reference voltage.

3. The bandgap voltage reference circuit as claimed in claim 1, wherein:

each of the first transistor and the second transistor is a P-type metal-oxide-semiconductor field-effect transistor, the first end of each of the first transistor and the second transistor is a drain end of the P-type metal-oxide-semiconductor field-effect transistor, the control end of each of the first transistor and the second transistor is a gate end of the P-type metal-oxide-semiconductor field-effect transistor, and the second end of each of the first transistor and the second transistor is a source end of the P-type metal-oxide-semiconductor field-effect transistor.

4. The bandgap voltage reference circuit as claimed in claim 1, wherein a voltage of the operational voltage end is higher than a voltage of the reference voltage end.

5. The bandgap voltage reference circuit as claimed in claim 1, wherein the bandgap current generating circuit comprises:

a first transistor, wherein a first end and a control end of the first transistor are coupled to a reference voltage end;

a second transistor, wherein a first end and a control end of the second transistor are coupled to the reference voltage end;

a first resistor, wherein a first end of the first resistor receives the bandgap reference voltage, and a second end of the first resistor is coupled to a second end of the first transistor to output the first voltage;

a second resistor, wherein a first end of the second resistor receives the bandgap reference voltage; and a third resistor, wherein a first end of the third resistor is coupled to a second end of the second resistor to output the second voltage, and a second end of the third resistor is coupled to a second end of the second transistor.

6. The bandgap voltage reference circuit as claimed in claim 5, wherein:

each of the first transistor and the second transistor is a bipolar junction transistor, the first end of each of the first transistor and the second transistor is a collector end of the bipolar junction transistor, the control end of each of the first transistor and the second transistor is a base end of the bipolar junction transistor, and the second end of each of the first transistor and the second transistor is an emitter end of the bipolar junction transistor.

7. The bandgap voltage reference circuit as claimed in claim 1, wherein the differential pair circuit comprises:

an operational amplifier, wherein a non-inverting input end of the operational amplifier receives the first voltage, an inverting input end of the operational amplifier receives the second voltage, and an output end of the operational amplifier outputs the third voltage.

8. The bandgap voltage reference circuit as claimed in claim 7, wherein the operational amplifier comprises:

a bias resistor, wherein a first end of the bias resistor is coupled to an operational voltage end;

a first input transistor, wherein a first end of the first input transistor is coupled to a second end of the bias resistor, and a control end of the first input transistor receives the first voltage;

a second input transistor, wherein a first end of the second input transistor is coupled to the second end of the bias resistor, and a control end of the second input transistor receives the second voltage;

a first load transistor, wherein a first end of the first load transistor is coupled to a reference voltage end, and a control end of the first load transistor is coupled to a second end of the first load transistor and a second end of the first input transistor; and a second load transistor, wherein a first end of the second load transistor is coupled to the reference voltage end, a control end of the second load transistor is coupled to the control end of the first load transistor, and a second end of the second load transistor is coupled to a second end of the second input transistor to output the third voltage.

9. The bandgap voltage reference circuit as claimed in claim 8, wherein a voltage of the operational voltage end is higher than a voltage of the reference voltage end.

10. The bandgap voltage reference circuit as claimed in claim 8, wherein:

each of the first input transistor and the second input transistor is a P-type metal-oxide-semiconductor field-effect transistor, the first end of each of the first input transistor and the second input transistor is a source end of the P-type metal-oxide-semiconductor field-effect transistor, the control end of each of the first input transistor and the second input transistor is a gate end of the P-type metal-oxide-semiconductor field-effect transistor, and the second end of each of the first input transistor and the second input transistor is a drain end of the P-type metal-oxide-semiconductor field-effect transistor; and each of the first load transistor and the second load transistor is an N-type metal-oxide-semiconductor field-effect transistor, the first end of each of the first load transistor and the second load transistor is a source end of the N-type metal-oxide-semiconductor field-effect transistor, the control end of each of the first load transistor and the second load transistor is a gate end of the N-type metal-oxide-semiconductor field-effect transistor, and the second end of each of the first load transistor and the second load transistor is a drain end of the N-type metal-oxide-semiconductor field-effect transistor.

11. A bandgap voltage reference circuit for generating a bandgap reference voltage, the bandgap voltage reference circuit comprising:

a bandgap current generating circuit configured to convert the bandgap reference voltage into a bandgap current and generate a first voltage and a second voltage according to the bandgap current;

a differential pair circuit, coupled to the bandgap current generating circuit to receive the first voltage and the second voltage, and configured to reduce a voltage difference between the first voltage and the second voltage, and generate a third voltage; and a flipped voltage follower, coupled to the differential pair circuit to receive the third voltage, configured to generate the bandgap reference voltage accordingly, and comprising:

a current source circuit, wherein a first end of the current source circuit is coupled to a reference voltage end;

a first transistor, wherein a first end of the first transistor is coupled to a second end of the current source circuit to provide a fourth voltage, and a control end of the first transistor is coupled to the differential pair circuit to receive the third voltage;

a second transistor, wherein a second end of the second transistor is coupled to an operational voltage end, a first end of the second transistor is coupled to a second end of the first transistor to output the bandgap reference voltage; and a voltage adjusting circuit, coupled between the second end of the current source circuit and a control end of the second transistor to generate and output a control voltage to the control end of the second transistor according to the fourth voltage.

12. The bandgap voltage reference circuit as claimed in claim 11, wherein the control voltage is higher than the fourth voltage.

13. The bandgap voltage reference circuit as claimed in claim 11, wherein the voltage adjusting circuit comprises:

a third transistor, wherein a control end of the third transistor is coupled to a bias voltage end, and a second end of the third transistor is coupled to the second end of the current source circuit to receive the fourth voltage; and a fourth transistor, wherein a second end of the fourth transistor is coupled to the operational voltage end, and a control end of the fourth transistor for outputting the control voltage is coupled to a first end of the fourth transistor, and is coupled to the control end of the second transistor and a first end of the third transistor.

14. The bandgap voltage reference circuit as claimed in claim 13, wherein:

each of the first transistor, the second transistor, and the fourth transistor is a P-type metal-oxide-semiconductor field-effect transistor, the first end of each of the first transistor, the second transistor, and the fourth transistor is a drain end of the P-type metal-oxide-semiconductor field-effect transistor, the control end of each of the first transistor, the second transistor, and the fourth transistor is a gate end of the P-type metal-oxide-semiconductor field-effect transistor, and the second end of each of the first transistor, the second transistor, and the fourth transistor is a source end of the P-type metal-oxide-semiconductor field-effect transistor; and the third transistor is an N-type metal-oxide-semiconductor field-effect transistor, the first end of the third transistor is a drain end of the N-type metal-oxide-semiconductor field-effect transistor, the control end of the third transistor is a gate end of the N-type metal-oxide-semiconductor field-effect transistor, and the second end of the third transistor is a source end of the N-type metal-oxide-semiconductor field-effect transistor.

15. The bandgap voltage reference circuit as claimed in claim 11, wherein the voltage adjusting circuit comprises:

a third transistor, wherein a control end of the third transistor is coupled to a bias voltage end, and a second end of the third transistor is coupled to the second end of the current source circuit to receive the fourth voltage; and a resistor, wherein a first end of the resistor is coupled to the operational voltage end, and a second end of the resistor is coupled to the control end of the second transistor and the first end of the third transistor to output the control voltage.

16. The bandgap voltage reference circuit as claimed in claim 11, wherein the current source circuit comprises:

a resistor, coupled between the first end of the first transistor and the reference voltage end.

17. The bandgap voltage reference circuit as claimed in claim 11, wherein a size of the second transistor is larger than a size of the first transistor.

18. The bandgap voltage reference circuit as claimed in claim 11, wherein a size of the second transistor is 20 times to 100 times of a size of the first transistor.

19. The bandgap voltage reference circuit as claimed in claim 11, wherein a voltage of the operational voltage end is higher than a voltage of the reference voltage end.

* * * * *